US006748880B2

(12) United States Patent
DeSellem

(10) Patent No.: US 6,748,880 B2
(45) Date of Patent: Jun. 15, 2004

(54) BOILER INTERNAL FLUE GAS BY-PASS DAMPER FOR FLUE GAS TEMPERATURE CONTROL

(75) Inventor: James F. DeSellem, Salineville, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/024,874

(22) Filed: Dec. 19, 2001

(65) Prior Publication Data

US 2002/0079374 A1 Jun. 27, 2002

Related U.S. Application Data

(60) Provisional application No. 60/257,134, filed on Dec. 20, 2000.

(51) Int. Cl.[7] ..... F23G 5/04; F23B 7/00; F23J 11/00; F23L 13/00; F23N 3/00

(52) U.S. Cl. ..... 110/345; 110/234; 110/147; 110/163; 122/479.5; 122/480

(58) Field of Search ..... 110/203, 234, 110/297, 302, 303, 304, 305, 308, 309, 310, 322, 323, 324, 325, 326, 147, 163, 345; 122/480, 479.5, 483

(56) References Cited

U.S. PATENT DOCUMENTS 2,886,013 A * 5/1959 Chan ..... 122/478
2,985,152 A * 5/1961 Paulison ..... 122/479
3,345,975 A * 10/1967 Stevens ..... 122/406
3,643,634 A * 2/1972 Soh ..... 122/483
4,245,569 A * 1/1981 Fallon ..... 110/215
4,738,226 A * 4/1988 Kashiwazaki et al. ..... 122/480
5,247,907 A * 9/1993 Lee et al. ..... 122/1 R
6,076,476 A * 6/2000 Yano et al. ..... 110/345
6,146,605 A * 11/2000 Spokoyny ..... 423/239.1

* cited by examiner

*Primary Examiner*—Kenneth Rinehart
(74) *Attorney, Agent, or Firm*—Eric Marich

(57) ABSTRACT

A flue gas passage arrangement for a steam generator which permits adjustment of the heat transfer effectiveness of a final bank of heat exchanger surface to control a temperature of the flue gas flowing through and exiting from the flue gas passage and conveyed to a downstream $NO_x$ reduction device having a minimum operating temperature. The $NO_x$ reduction device is advantageously an SCR. Economizer heating surface is located within the flue gas passage, and a baffle plate extends through the flue gas passage and creates two flue gas paths there through. The economizer heating surface may be a single, common bank having a section located in both gas paths, or in only one gas path. Alternatively, two separate banks of economizer heating surface may be employed. A variable position damper is provided in one gas path, either below or above one section. The variable position damper can be selectively opened or closed to permit or restrict the flow of flue gases through the second section to control the effectiveness of the economizer heating surface to maintain the temperature of the flue gas conveyed to the downstream $NO_x$ reduction device at or above the minimum operating temperature.

12 Claims, 6 Drawing Sheets

BOILER INTERNAL FLUE GAS BY-PASS DAMPER FOR FLUE GAS TEMPERATURE CONTROL

This application claims the benefit of Provisional Application No. 60/257,134 filed Dec. 20, 2000.

FIELD AND BACKGROUND OF THE INVENTION

The present invention relates generally to the field of fossil-fueled boilers and steam generators used in the production of steam for industrial processes or utility power generation. More particularly, the present invention relates to an internal flue gas by-pass damper which can be used to control the temperature of the flue gas provided to downstream devices by controlling the effectiveness (ability to absorb heat) of the final banks of heat exchanger surfaces forming a part of the boiler or steam generator.

Nitrogen oxides ($NO_x$), along with sulfur oxides ($SO_x$) and particulate matter, are one of the primary pollutants emitted during combustion processes, and are the subject of various state and national regulatory policies. For a general description of these environmental considerations and equipment and methods used to control these pollutants, the reader is referred to *STEAM/its generation and use,* $40^{th}$ Edition, Stultz and Kitto, Jr., Eds., Copyright © 1992, The Babcock & Wilcox Company, particularly Chapters 32 through 36.

As described in Chapter 34 of *STEAM 40th*, pages 34–1 through 34–9, the text of which is hereby incorporated by reference as though fully set forth herein, one method for controlling $NO_x$ emissions produced by such boilers or steam generators comprises systems employing selective catalytic reduction (SCR) technology. SCR systems catalytically reduce flue gas $NO_x$ to $N_2$ and $H_2O$ using ammonia in a chemical reaction. The $NO_x$ reduction reactions take place as the flue gas, into which ammonia has been introduced and mixed, passes through a catalyst chamber.

The proper operation of such SCR systems requires that the temperature of the flue gas entering the SCR system be controlled within a specific temperature range, typically 450 to 840 F. (232 to 449 C.). Often, optimum performance occurs between 675 and 840 F. (357 and 449 C.), and it is desirable to maintain the temperature of flue gases leaving the last heat exchanger of a boiler and entering an SCR at or above the $NO_x$ reduction catalyst's minimum operating temperature. However, the flue gas temperature leaving a boiler or steam generator does not remain constant with changes in boiler or steam generator load (as defined and measured by the amount of steam production), the flue gas temperature exiting from the boiler or steam generator typically decreasing as steam production decreases. Nonetheless, the minimum flue gas temperature entering the catalyst must be maintained at or above the $NO_x$ reduction catalyst's minimum operating temperature even as the boiler load is reduced.

The current method of keeping the temperature of the flue gas leaving the last heat exchanger surface of a boiler or steam generator at or above the SCR $NO_x$ reduction catalyst's minimum operating temperature as the boiler load is reduced is to install a by-pass flue system. The by-pass flue diverts and transports a portion of the flue gases from a point upstream of the last heat exchanger surface in the boiler or steam generator (which is typically a bank of economizer heat transfer surface) to a location just upstream of the SCR. The diverted flue gases flowing through the by-pass flue is at a higher temperature since they did not pass over (and transfer heat to) the economizer heat exchanger surfaces. Thus, the diverted flue gases raise the overall temperature of the flue gases entering the SCR above the minimum temperature requirement.

In certain cases where existing boilers or steam generators are being retrofitted with SCR systems there is either insufficient space to install such a by-pass flue, or to install such a by-pass flue in a cost-effective manner. Some situations may require major building modifications, relocation of major equipment, and/or significant boiler pressure part changes. In such cases, there would be either no control over the temperature of the flue gases entering the SCR, or the installation of a by-pass flue would be so costly as to be prohibitive of making the modification. A system which would permit retrofit installation of such SCR systems in situations where provision of such flue gas by-pass flues is impractical, while still providing control of the flue gas temperature entering the SCR, would be welcomed by industry.

SUMMARY OF THE INVENTION

The present invention can be used to control the temperature of flue gas produced by a boiler or steam generator based upon the temperature requirements of a downstream (with respect to a direction of flue gas flow) device which receives the flue gas. A particular application of the present invention involves an apparatus for controlling the flue gas temperature entering a downstream selective catalytic reduction (SCR) system used to reduce atmospheric $NO_x$ emissions from the boiler or steam generator.

One aspect of the present invention is thus to provide a device for controlling the temperature of flue gases entering an SCR which does not require significant additional space and modifications typically required when flue gas by-pass flues are added outside of the existing flues associated with the boiler or steam generator.

Another aspect of the present invention is to provide a device for maintaining the temperature of flue gas provided to an SCR system above an SCR minimum operating temperature at different boiler load conditions.

In its most basic form, the present invention dispenses with the need to provide the known flue gas by-pass flue systems and instead adjusts the heat transfer effectiveness (ability to absorb heat) of the final banks of heat exchanger surface (typically economizer and primary superheater surface) of the boiler or steam generator to provide a variable effectiveness heat transfer surface for controlling the temperature of the flue gases entering the SCR.

Accordingly, one aspect of the present invention is drawn to a flue gas passage arrangement for a steam generator which permits adjustment of the heat transfer effectiveness of a final bank of heat exchanger surface to control a temperature of the flue gas flowing through the flue gas passage and conveyed to a downstream $NO_x$ reduction device having a minimum operating temperature. Economizer heating surface is located within the flue gas passage. A baffle plate extends through the flue gas passage and creates two flue gas paths there through. The economizer heating surface is located in at least one of a first and a second section defined by the flue gas paths, one section in each flue gas path. Finally, damper means are provided, positioned in the second section and connected between the baffle plate and walls of the flue gas passage. The damper means is used for selectively permitting or restricting the flow of flue gases through the second section. In this way, the heat transfer effectiveness of the economizer heating surface is controllable with the damper means to maintain the temperature of the flue gas conveyed to the downstream $NO_x$ reduction device at or above the minimum operating temperature of the $NO_x$ reduction device.

The variable position damper can be full open to allow flue gases to pass equally over the combined heat exchanger surface area of both sections, or progressively closed, to reduce the effective heat exchanger surface area. The total heat exchanger surface area and apportionment of the total convection pass gas flow area between the two sections is determined based on the maximum and minimum boiler loads and required minimum operating temperature for flue gases entering the $NO_x$ reduction device.

Alternatively, two separate heat exchanger banks may be provided divided by a separator plate and one heat exchanger bank has a variable position damper located beneath it.

Still further, another arrangement involves providing the economizer heat exchanger in only one path, with an open path created along one side of the heat exchanger bank. A variable position damper is provided at the end of the open path for variably restricting flue gas flow through that path.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1:
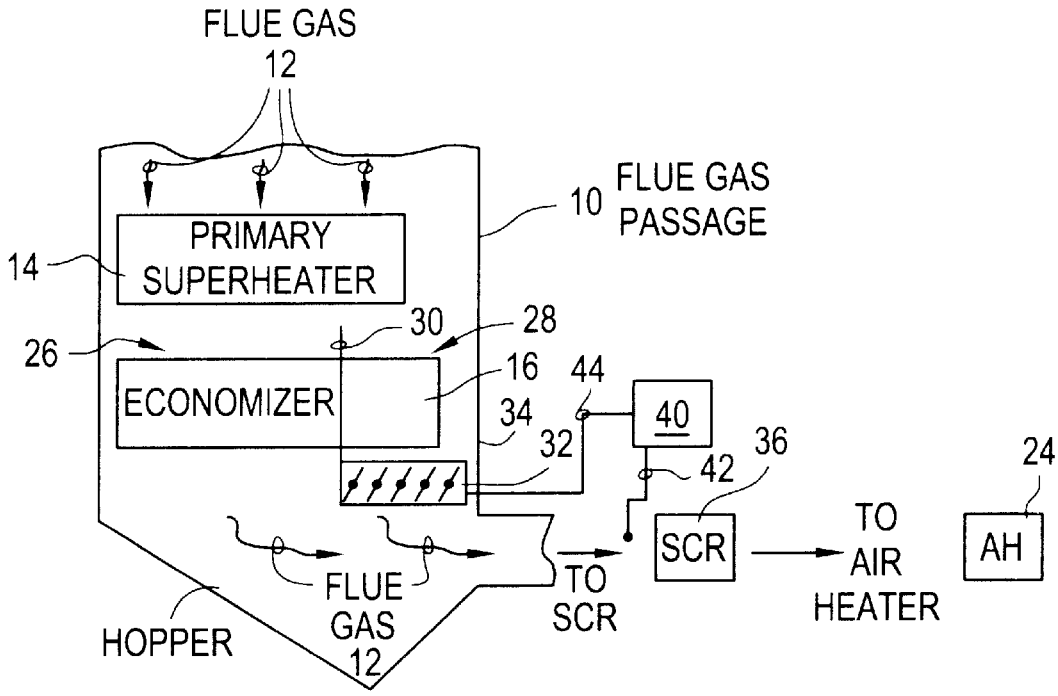
FIG. 1 is a sectional side elevational view of a first embodiment of the invention, wherein a baffle plate extends within a flue gas passage to create two separate gas paths through a common bank of economizer surface, damper means located in one of the gas paths.

In the drawings annexed to and forming a part of this disclosure, like reference numerals designate the same or functionally similar elements throughout the several drawings. FIG. 1 illustrates a first embodiment of the present invention. A flue gas passage 10 of a boiler or steam generator is illustrated, defined by walls 11 as shown. Flue gas passage 10 is also referred to as the convection pass 10 because the predominant heat transfer mechanism at this location is via convective heat transfer between the hot flue gases 12 and the heat exchanger surfaces. For a general description of such a boiler convection pas construction, the reader is referred to FIG. 7 on page 34–5 of the aforementioned *STEAM* 40*th* reference.

The heat exchanger surfaces comprise primary superheater or superheater tube bank(s) 14, and economizer tube bank(s) 16, 18, 20, 22, located therein. The primary superheater 14 is located upstream (with respect to a direction of flue gas 12 flow through the convection pass 10) and receives the flue gas 12 flowing there across before it passes to the downstream economizer surfaces. The economizer surfaces are typically the last boiler or steam generator heat exchanger surfaces encountered by the flue gas 12 before it is conveyed to the air heater 24. As illustrated in FIG. 1, according to the present invention, the economizer tube bank 16 can be considered to be located in two sections 26, 28, separated by a separator or baffle plate 30 which creates two gas paths across the economizer tube bank 16.

The primary superheater 14 and economizer 16 tube banks separately carry steam and water, respectively. Each primary superheater 14 and economizer 16 is comprised of a plurality of tubes connected to a common location at their ends and having an inlet and an outlet. The tube banks 14, 16 form heat exchanger surfaces for transferring heat from the hot flue gases 12 which pass there across into the heat transfer medium (steam or water as the case may be) flowing within the tubes.

The baffle or separator plate 30 is a perpendicular baffle which extends through and above and below (upstream and downstream) the common bank of economizer 16. It creates two flow paths for the flue gas 12 through the economizer 16, and substantially prevents the flue gases 12 from flowing between the first and second sections 26, 28 of the economizer 16. In the embodiment of FIG. 1, the separator plate 30 has openings (not shown) which fit around the tubes in the economizer bank 16 and permit the tubes to pass there through, while substantially preventing flue gases 12 from flowing from one flue gas path to the other.

Damper means, preferably a louvered damper 32 is positioned below second economizer section 28 and is connected between a wall 34 of the convection pass 10 and the baffle or separator plate 30. The louvered damper 32 has several rotatable louvers movable anywhere from fully open to sealed closed. The position of the louvers controls the effectiveness (ability to absorb heat) of the economizer 16 by controlling the flow of flue gas 12 over the second section 28. When the effective surface area of the economizer 16 available to contact the flue gas 12 is reduced, the amount of heat removed from the flue gas 12 is reduced as well. Providing the louvered damper 32 beneath a portion of the economizer 16 permits variable control over the effective surface area of the economizer 16 so that it may be adjusted between full load and partial load conditions of the boiler. Preferably, the economizer 16 is made less effective as the boiler load decreases by closing it, diverting the flue gases 12 across only a portion of the economizer 16 and thereby reducing heat transfer to the water flowing therein so that the temperature of flue gases 12 exiting from the economizer 16 and entering SCR 36 or another $NO_x$ reduction device is maintained above a minimum operating temperature.

Schematically this control function is illustrated in FIG. 1, wherein controller means 40 receives a signal indicative of the flue gas temperature entering the SCR 36 along line 42, and outputs a control signal to adjust the damper 32 position (either open or closed) along line 44. The controller means 40 could be under the manual control of a human operator, or automated as part of a feedback or feed forward control scheme.

Almost all retrofit SCR installations on existing boilers or steam generators have surrounding building and/or equipment interferences. The final heat exchanger surface can be replaced or retrofitted in the existing boiler along with a $NO_x$ reduction device such as an SCR 36 without requiring a larger plan area for the boiler or steam generator. The flue gas 12 diverted from otherwise passing across the second section 28 provides variable control necessary to maintain the operating temperature of the SCR 36 without occupying additional space or requiring extensive modifications to surrounding structures or equipment which would otherwise be required to implement a flue gas by-pass flue solution.

Because the final heat exchanger surface (economizer 16) is located at the coldest end of the convection pass 10, the operating temperatures will typically be sufficiently low so that the damper 32 may be constructed of relatively inexpensive alloys, such as a carbon steel material. With the damper 32 closely following the economizer heat exchanger section 30 and essentially becoming part of the heat exchanger 30, it thereby substantially eliminates the problems of differential expansion of materials, the need for mixing devices, or additional dampers which are required in known flue gas by-pass systems.

Figure 11:
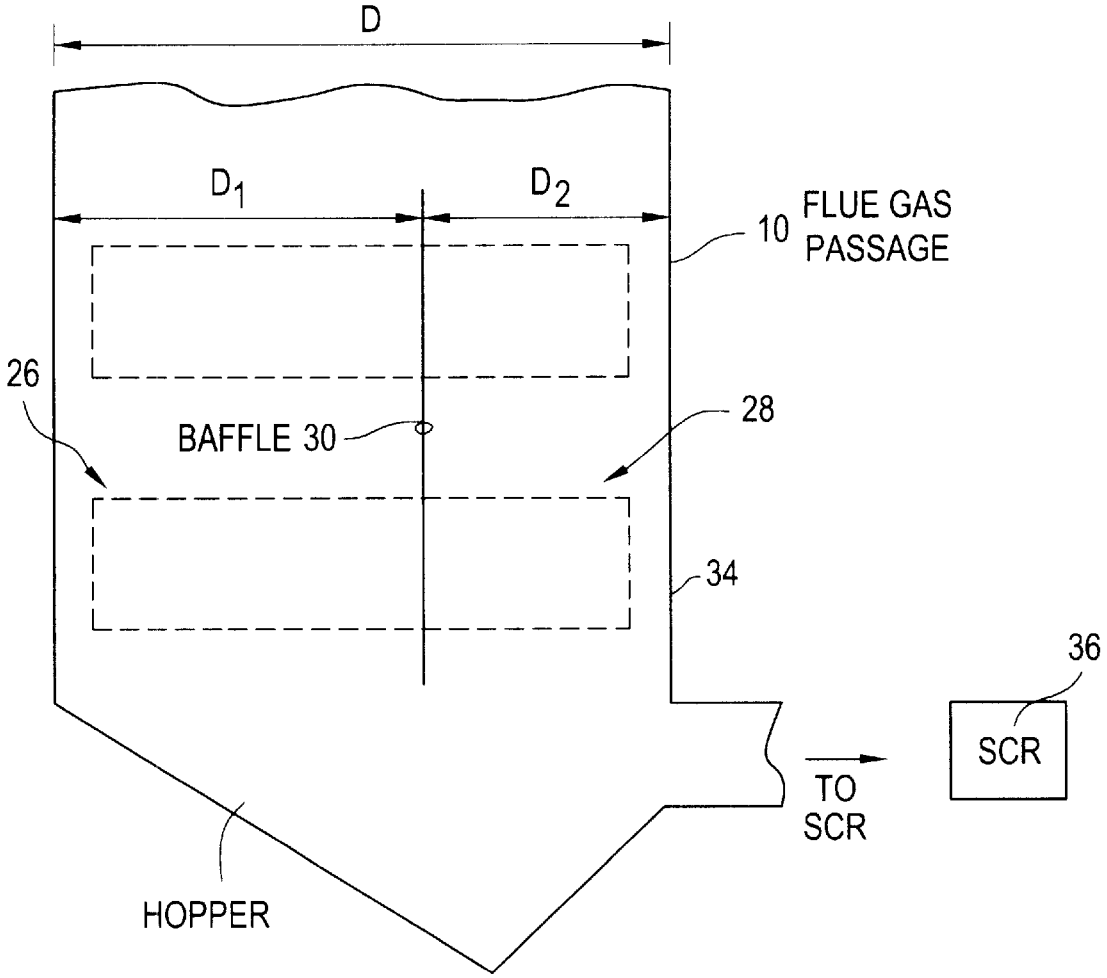
FIG. 11 is a schematic sectional side elevational view illustrating how the baffle plate can be located according to the invention to achieve desired gas path depths $D_1$ and $D_2$ within the flue gas passage.

The specific position of the separator plate 30 within the flue gas passage 10 will depend on the boiler where the heat exchanger 16 is installed, based upon heat transfer and/or flue gas path resistance considerations as required. Typically, the ratio of the area of the first section to the area of the second section will be between 0.5 and 1.5. As used herein, area refers to the area of the flue gas passage 10 in a horizontal plane across the entrance to each respective section 26, 28. Since boiler or steam generator convection passes 10 are typically a constant width, and where the overall depth of the convection pass or flue gas passage 10 is designated D, such an area ratio can be equally expressed as a ratio of the depths $D_1$ and $D_2$ of each gas path defined by the baffle 30, as illustrated in FIG. 11.

Alternative embodiments of the present invention are illustrated in the remaining Figures.

Figure 2:
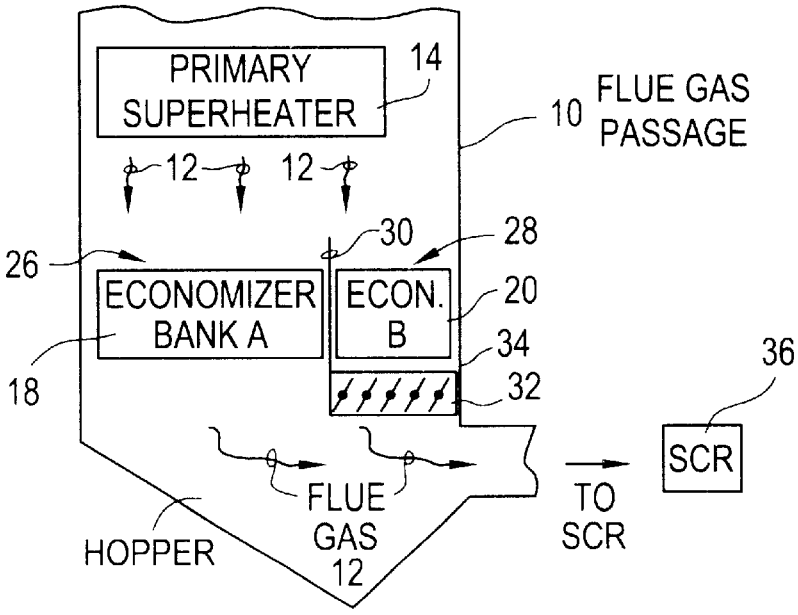
FIG. 2 is a sectional side elevational view of a second embodiment of the invention wherein a baffle plate extends within a flue gas passage to create two separate gas paths each containing separate banks of economizer surface, damper means located in one of the gas paths.

In FIG. 2, the final heat exchanger is formed by two separate economizer tube banks 18 and 20 (economizer banks A and B, respectively), isolated from each other by the separator or baffle plate 30, rather than the common bank of economizer 16 in FIG. 1. The baffle plate 30 again forms two sections much like those illustrated in FIG. 1, but in this case there is no need for the baffle plate 30 to have openings to permit tubes in the economizer tube banks A and B to pass because the tube banks A and B are wholly separate from each other. Louvered damper 32 is again positioned below economizer tube bank 20 and is operated in the same manner as with the embodiment of FIG. 1. That is, the damper 32 is closed as boiler steam load is reduced to direct the flue gas 12 towards economizer bank A and away from economizer bank B.

Figure 3:
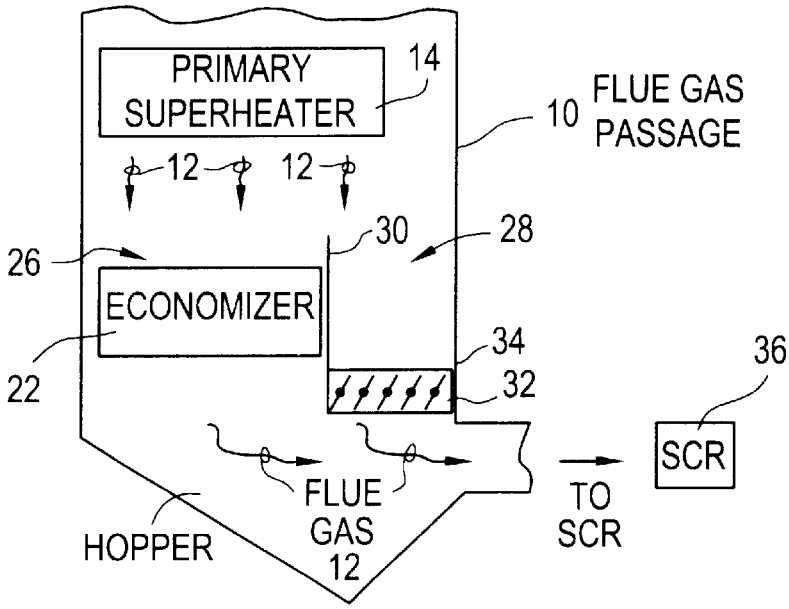
FIG. 3 is a sectional side elevational view of a third embodiment of the invention wherein a baffle plate extends within a flue gas passage to create two separate gas paths, one gas path containing a bank of economizer surface and the other containing damper means.
Figure 4:
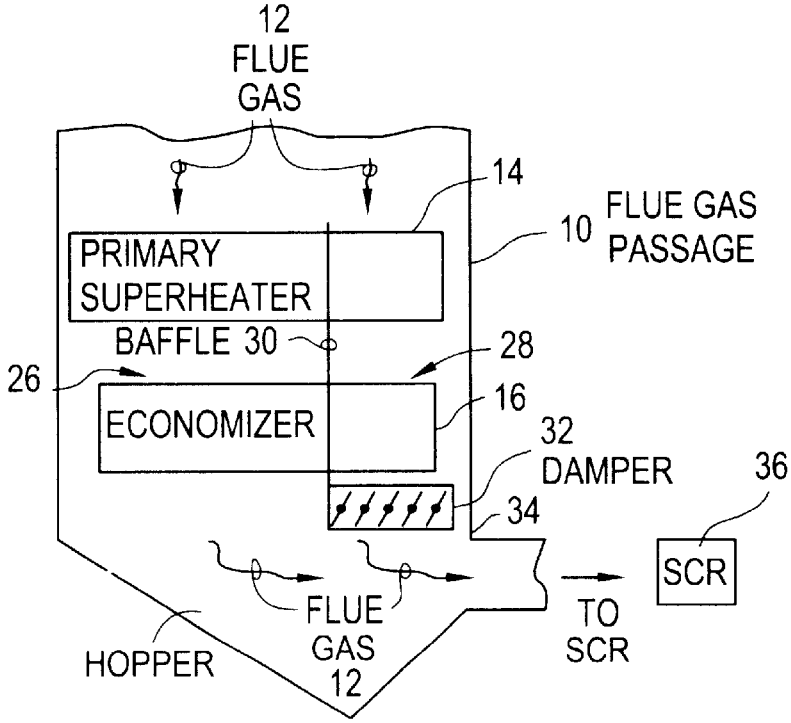
FIG. 4 is a sectional side elevational view of a fourth embodiment of the invention, wherein a baffle plate extends within a flue gas passage to create two separate gas paths through a common bank of superheater surface and a common bank of economizer surface, damper means located in one of the gas paths.
Figure 5:
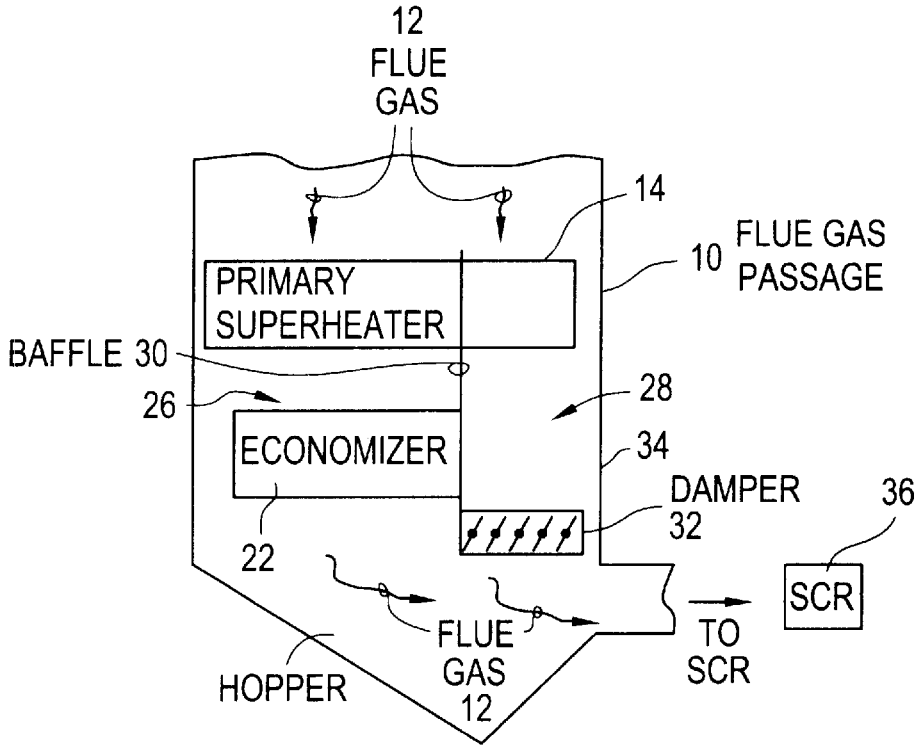
FIG. 5 is a sectional side elevational view of a fifth embodiment of the invention wherein a baffle plate extends within a flue gas passage to create two separate gas paths through a common bank of superheater surface, one gas path containing a bank of economizer surface and the other containing damper means.
Figure 6:
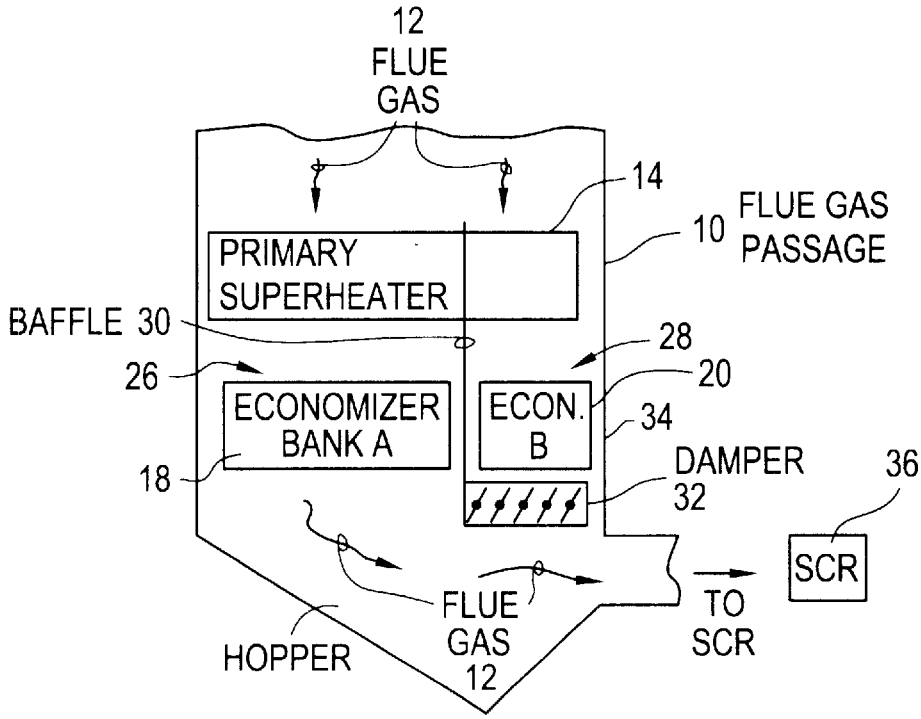
FIG. 6 is a sectional side elevational view of a sixth embodiment of the invention wherein a baffle plate extends within a flue gas passage to create two separate gas paths through a common bank of superheater surface, each containing separate banks of economizer surface, damper means located in one of the gas paths.

The embodiment of FIG. 3 employs an economizer tube bank 22 having an effective area sufficient to extract a required amount of heat from the flue gases 12 generated by the boiler or steam generator operating at full load. Separator or baffle plate 30 is provided on the internal side of economizer 22 to form the two flue gas flow sections. However, no economizer tubes are provided in the second section above or upstream of the louvered damper 32. Here, the louvered damper 32 is substantially the same as in FIG. 1, but it has the opposite function. When the boiler is at full load and the economizer 22 must operate at a higher effectiveness, the damper 32 can be closed so that all of the flue gas 12 passes over the economizer 22. When lower effectiveness is required, the damper 32 can be opened to permit a portion of the flue gases 12 to bypass the economizer 22 without transferring heat.

While a specific embodiment of the invention has been shown and described in detail to illustrate the application of the principles of the invention, it will be understood that changes may be made in the form of the invention covered by the following claims without departing from such principles. For example, the present invention may be applied to new construction involving SCR systems, or to the replacement, repair or modification of existing boilers or steam generators to which SCR systems are to be applied.

Figure 7:
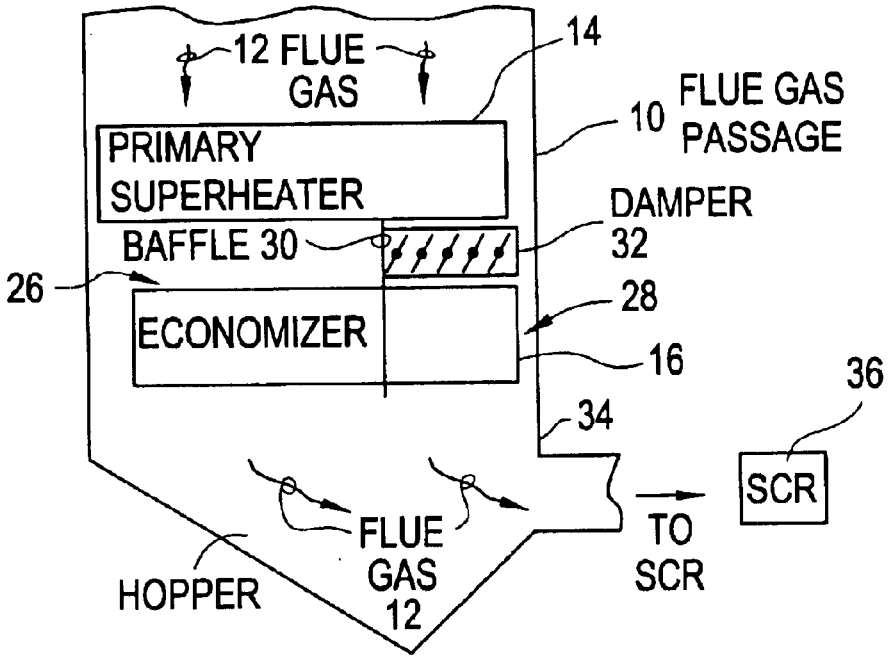
FIG. 7 is a sectional side elevational view of a seventh embodiment of the invention, wherein a baffle plate extends within a flue gas passage to create two separate gas paths through a common bank of economizer surface, damper means located in one of the gas paths in between an upstream bank of superheater surface and the bank of economizer surface.
Figure 8:
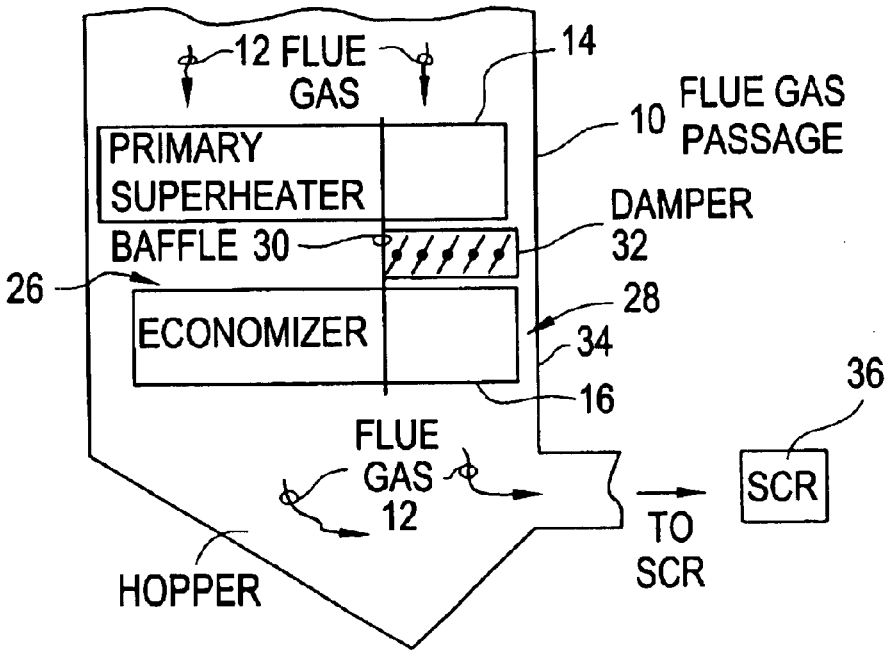
FIG. 8 is a sectional side elevational view of an eighth embodiment of the invention, wherein a baffle plate extends within a flue gas passage to create two separate gas paths through a common bank of superheater surface and a common bank of economizer surface, damper means located in between the common banks in one of the gas paths.
Figure 9:
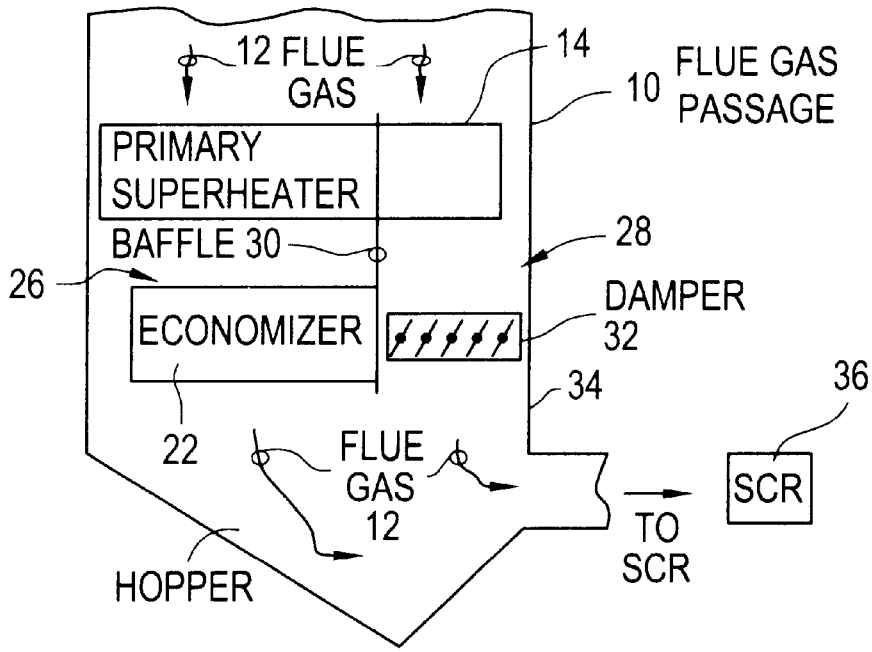
FIG. 9 is a sectional side elevational view of a ninth embodiment of the invention wherein a baffle plate extends within a flue gas passage to create two separate gas paths through a common bank of superheater surface, one gas path containing a bank of economizer surface and the other containing damper means directly opposite the bank of economizer surface.
Figure 10:
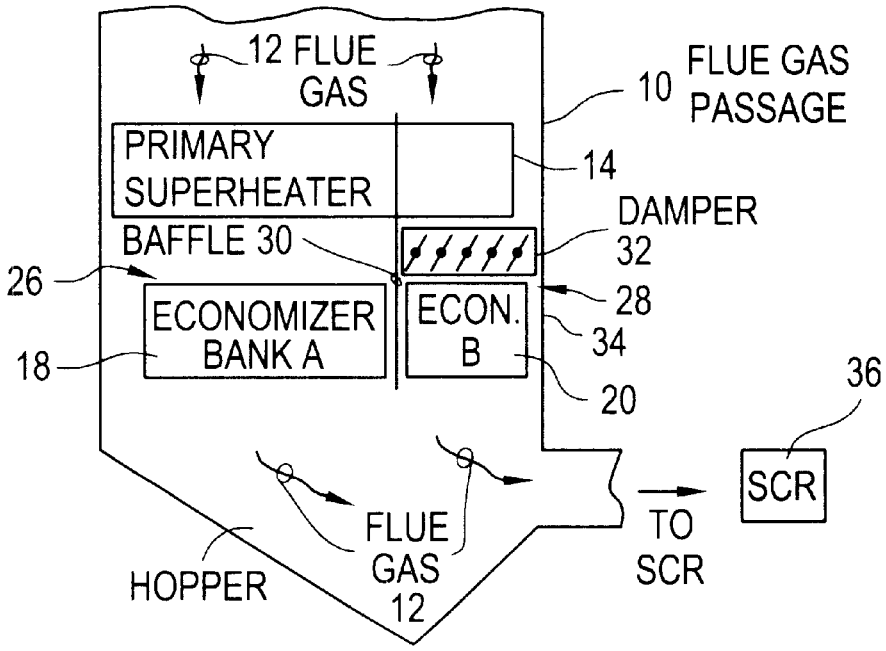
FIG. 10 is a sectional side elevational view of a tenth embodiment of the invention wherein a baffle plate extends within a flue gas passage to create two separate gas paths through a common bank of superheater surface, each containing separate banks of economizer surface, damper means located in one of the gas paths in between the common bank of superheater one of the separate banks of economizer surface.

In some embodiments of the invention, certain features of the invention may sometimes be used to advantage with or without a corresponding use of the other features. For example, it is envisioned that the baffle plate 30 could be extended further into the upstream flue gas flow 12, including into the superheater 14, to further increase the effectiveness and control provided by the damper 32. This aspect is illustrated in FIGS. 4, 5, 6 and 8, 9, 10 and 11. It is also envisioned that the damper 32 could be provided at the upper end of the section 30, as illustrated in FIGS. 7, 8 and 10, or adjacent to the economizer 16 as in FIG. 9, although in these cases it may have to be made of more expensive, higher grade alloy materials in order for it to be able to withstand the higher flue gas 12 temperatures. Similarly, while a louvered damper 32 is preferred for use, other types of damper constructions or other types of flow restricting devices could be used as space and performance dictate. Accordingly, all such changes and embodiments fall within the scope and equivalents of the following claims.

I claim:

1. A method of maintaining the temperature of flue gas conveyed from a boiler to a downstream device within a preselected temperature range, comprising:

providing a flue gas passage having two flue gas paths therein;

locating economizer heating surface in at least one of the flue gas paths;

providing damper means in only one of the flue gas paths;

adjusting the damper means to control the amount of heat removed from the flue gas by the economizer heating surface thereby maintaining the temperature of the flue gas within a preselected temperature range; and keeping the other flue gas path devoid of damper means.

2. A method of maintaining the temperature of flue gas conveyed from a boiler to a downstream device within a preselected temperature range, comprising:

providing a flue gas passage having a baffle plate extending through the flue gas passage to create two flue gas paths therethrough;

locating economizer heating surface in at least one of the flue gas paths;

providing damper means positioned in only one of the flue gas paths and connected between the baffle plate and the walls of the flue gas passage;

keeping the other flue gas path devoid of damper means;

providing a signal indicative of the flue gas temperature; and adjusting the damper means in response to the signal to control the amount of heat removed from the flue gas by the economizer heating surface thereby maintaining the temperature of the flue gas within a preselected temperature range.

3. A flue gas passage arrangement for a steam generator which permits adjustment of the heat transfer effectiveness of a final bank of heat exchanger surface to control the temperature of the flue gas flowing through the flue gas passage and conveyed to a downstream $NO_x$ reduction device having a minimum operating temperature, comprising:

economizer heating surface located within the flue gas passage;

a baffle plate extending through the flue gas passage which creates two flue gas paths therethrough, the economizer heating surface located in at least one of a first and a second section, one section in each flue gas path; and damper means positioned in the second section and connected between the baffle plate and walls of the flue gas passage, the damper means for selectively permitting or restricting the flow of flue gases through the second section, the first section being devoid of damper means, and wherein the effectiveness of the economizer heating surface is controllable with the damper means in the second section to maintain the temperature of the flue gas conveyed to the downstream $NO_x$ reduction device at or above the minimum operating temperature of the $NO_x$ reduction device.

4. The arrangement according to claim 1, wherein the baffle plate divides the flue gas passage into two sections, and a ratio of an area of the first section to an area of the second section is between 0.5 and 1.5.

5. The arrangement according to claim 3, comprising a common bank of superheater heating surface located within the flue gas passage at a location upstream of the economizer heating surface.

6. The arrangement according to claim 5, wherein the baffle plate extends within the flue gas passage to create two separate gas paths through the common bank of superheater heating surface.

7. The arrangement according to claim 3, wherein the economizer heating surface is located in both the first and second sections.

8. The arrangement according to claim 3, wherein a separate bank of economizer heating surface is located in each of the first and second sections.

9. The arrangement according to claim 3, wherein the economizer heating surface is located only in the first section and the baffle plate is directly adjacent one side of the economizer heating surface so that the second section does not contain any portion of the economizer heating surface.

10. The arrangement according to claim 5, wherein the damper means is located in one of the gas paths in between the common bank of superheater and the economizer heating surface, and the other gas path is devoid of damper means.

11. The arrangement according to claim 3, wherein the damper means is located in one of the gas paths below the economizer heating surface, and the other gas path is devoid of damper means.

12. The arrangement according to claim 9, wherein the damper means is located in one of the gas paths directly adjacent one side of the economizer heating surface, and the other gas path is devoid of damper means.

* * * * *